US006784628B1

(12) United States Patent
Horowitz

(10) Patent No.: US 6,784,628 B1
(45) Date of Patent: Aug. 31, 2004

(54) FLUORESCENT LIGHT CONTROL CIRCUIT

(76) Inventor: Victor Horowitz, 3359 Ocean Ave., Oceanside, NY (US) 11572

( * ) Notice: Subject to any disclaimer, the term of this patent is extended or adjusted under 35 U.S.C. 154(b) by 0 days.

(21) Appl. No.: 10/457,253

(22) Filed: Jun. 9, 2003

(51) Int. Cl.[7] ..... H05B 37/00

(52) U.S. Cl. ..... 315/312; 315/314; 315/318; 315/320; 315/321

(58) Field of Search ..... 315/312–325

(56) References Cited

U.S. PATENT DOCUMENTS

| | | | | | |
|---|---|---|---|---|---|
| 4,766,353 | A | * | 8/1988 | Burgess | 315/324 |
| 5,177,404 | A | * | 1/1993 | Cohen et al. | 315/320 |
| 5,248,919 | A | * | 9/1993 | Hanna et al. | 315/291 |
| 6,252,358 | B1 | * | 6/2001 | Xydis et al. | 315/295 |
| 6,731,080 | B2 | * | 5/2004 | Flory | 315/312 |

* cited by examiner

*Primary Examiner*—Don Wong
*Assistant Examiner*—Ephrem Alemu
(74) *Attorney, Agent, or Firm*—Reed Smith LLP

(57) ABSTRACT

A control system for selectively illuminating fluorescent light units in a fluorescent fixture having a plurality of fluorescent light units. A control system employs a first relay which when energized connects one of the light units to energizing power and a second relay which when energized connects a second and third light unit to energizing power. The control switch has one position in which the first relay is energized to turn on the first light unit and a second position in which the second relay is energized to turn on the second and third light units. The control switch also has a third position in which both relays are energized thereby turning on all three light units. Current steering through diodes in the switch and at the relays permits a single wire to be employed connecting the switch at a convenient manually accessible area to the relays at the fluorescent light fixture.

16 Claims, 1 Drawing Sheet

FLUORESCENT LIGHT CONTROL CIRCUIT

BACKGROUND OF THE INVENTION

This invention relates in general to a circuit for controlling the number of fluorescent lights turned on in a bank of such lights.

There are circumstances, primarily in order to save power, in which it is desirable for the fluorescent lights in commercial and industrial establishments to be dimmed, or selectively turned off, to provide less than maximum light output.

Full 100% light levels are required when the establishment is in full operation with a full complement of personnel. But there are times when substantially lower light lower levels are desired, particularly when the establishment is not operating. For security and safety reasons, there is usually a desire to maintain some light level.

There are known ways of dimming the lights through the use of electronic dimming ballasts. These are expensive techniques and are thus frequently not used.

There are known techniques to selectively turn off fluorescent tubes through coded signals delivered on a carrier signal. This technique is expensive and is subject to signal degradation and errors due to noise and extraneous signals picked up by the line which delivers the carrier signal.

Accordingly, what is required, and which is an object of this invention, is an inexpensive, simple to use system, secure from failure due to external signals, to provide an ability to selectively turn off fluorescent lights in a set of fluorescent lights.

Definitions

The term "light unit" is used herein to refer to the unit consisting of a ballast and the fluorescent tubes controlled by that ballast. Normally a light unit will be a single ballast and two tubes. There are times when a light unit can be a single ballast and one tube. Applicant is not aware of any situation where a single ballast controls more than two tubes. However, it should be understood herein that the term light unit refers to a single ballast and whichever number of tubes are controlled by that ballast.

A light fixture is normally composed of a plurality of such light units. Four light units for a fixture is very common. Such a fixture would have four ballasts and eight fluorescent tubes. But any number of light units can be contained in a single fixture.

BRIEF DESCRIPTION

In brief, the fluorescent lights in a fixture are selectively turned on or off by virtue of energization of relays coupled thereto. The relays control the state of normally open switches. The switches close when the relay is turned on to connect the associated light unit (i.e. fluorescent tubes and ballast) to a source of power. When open, the switch disconnects the light unit. The relays, in turn, are energized selectively either individually or in groups by the position of an arm on a manually operated rotary switch.

For example, in a four ballast fixture, one light unit can be continuously connected to the power line in order to provide at least 25% illumination.

A second light unit is connected to the power line through a first relay to provide an additional 25% illumination when that relay is energized and its associated contact is closed. This provides a total of 50% illumination.

Third and fourth light units are coupled to the source of energy by virtue of a second relay. When energized, the second relay closes associated switches and turns on the third and fourth light units to provide a 50% illumination, which with the first light unit provides a total of 75% illumination.

When both relays are energized, 100% illumination is provided.

The relays are connected to energizing power through the terminals of a rotary switch. Diodes block and steer current flow to the relays depending on the rotary switch terminal selected by the user.

DESCRIPTION OF THE PREFERRED EMBODIMENTS

Figure 1:
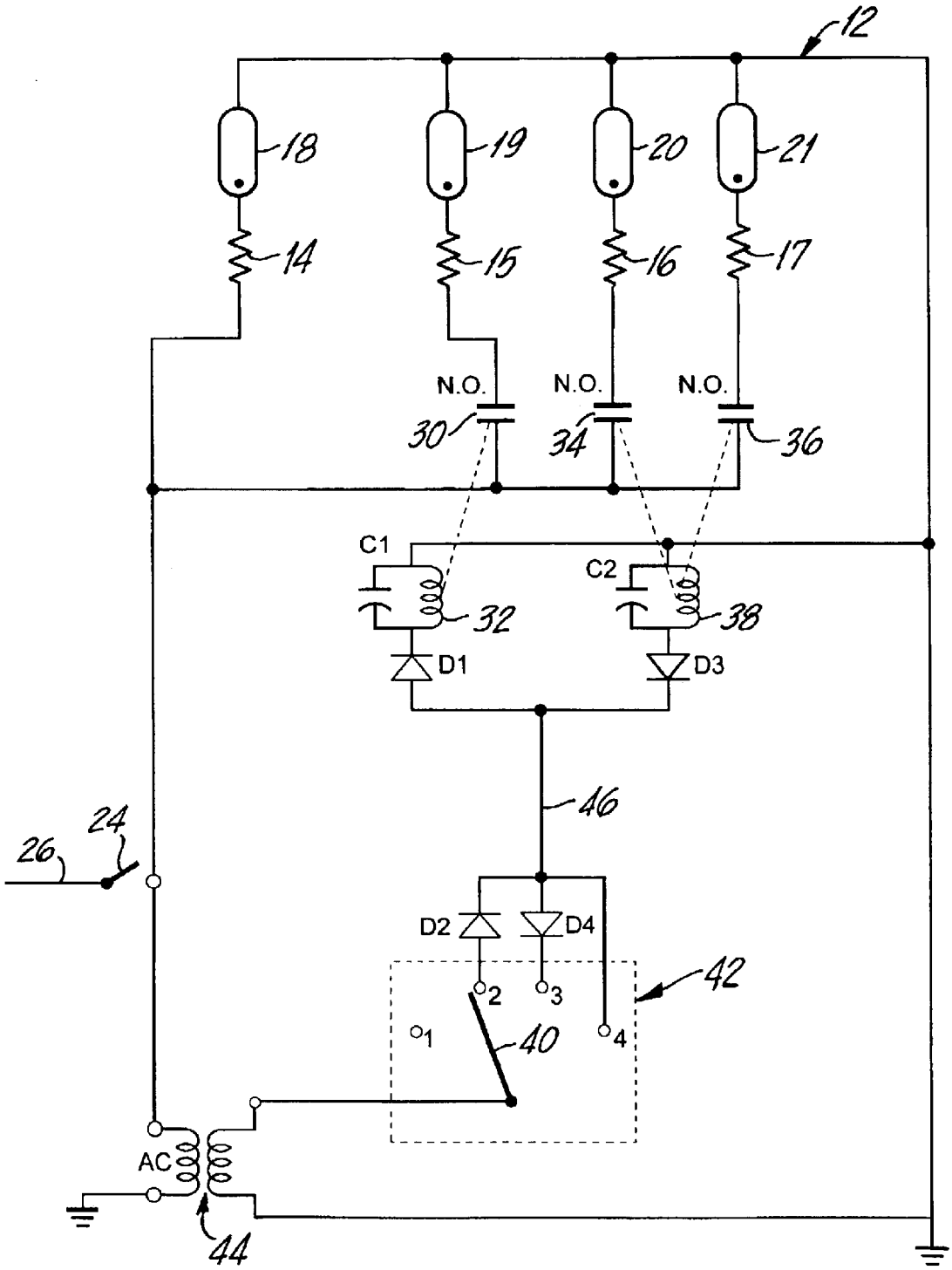
FIG. 1 is an electrical schematic of an embodiment of this invention applied to a fluorescent fixture having four light units; and specifically four ballasts and four sets of fluorescent tubes.

The FIGURE shows a fixture 12 containing a set of four light units; specifically four fluorescent tube ballasts 14, 15, 16, 17 and four associated sets of fluorescent tubes 18, 19, 20, 21. Each ballast normally is associated with more than a single fluorescent tube. Two tubes to a ballast are common.

A source of AC power is provided through a main switch 24 and delivered over line 26 to the ballast side of the fixture 12. The other side of the fixture 12 is connected to ground 28.

A first tube 18 is on at all times when the main switch 24 is closed and provides 25% illumination.

A second tube 19 is coupled to the source of power through a normally opened relay contact 30 that is closed when the associated relay coil 32 is energized.

Similarly, the third and fourth fluorescent tubes 20, 21 are turned on when the normally open contacts 34 and 36 are closed by energization of the relay coil 38.

Which of the relay coils 32 and 38 are energized is determined by the diodes D1, D2, D3 and D4 and the position of the arm 40 of the manually operated rotary switch 42. Power from the line 26 is connected to one of the switch terminals 1, 2, 3, or 4 by the position of the rotary arm 40. A transformer 44 is employed, if required, for the purpose of reducing the voltage on the line 46 to that required by the relays.

When the contact arm 40 is on terminal 1, neither of the relays is energized and only the first light 18 is turned on.

When the contact arm 40 is on terminal 2, the diodes D2 and D1, having the same polarity, pass current during the positive half of each AC cycle, energizing the relay coil 32 to close the switch 30 and thereby turn on the light 19. The capacitor C1 is selected for whatever capacitance is necessary to assure that the relay 32 stays energized during the negative half of the AC cycle. Because of the opposing plurality of the diodes D2 and D3, current passed by the diode D2 during the positive half cycle is blocked by the diode D3 from the relay coil 38.

However, when the switch arm 40 is on terminal 3, the diodes D4 and D3 pass current to the relay coil 38 during the negative half of each AC cycle. The capacitor C2 provides the function of assuring that in the blocked halt of the cycle, energy is maintained to keep the relay 38 turned on. With the relay coil 38 energized, its normally open contacts 34 and 36 are closed thereby turning on the lights 20 and 21 to provide 50% illumination. In this state, the opposing polarization of the diodes D1 and D4 assures that when the switch arm 40 is at terminal 3, the relay coil 32 is not energized.

When the switch arm 40 is on terminal 4, the two diodes D2 and D4 are bypassed and the positive half of each cycle energizes the relay coil 32 while the negative half energizes relay coil 38. With appropriate assist from the capacitors C1 and C2, this causes normally open contacts 30, 34 and 36 to close thereby turning on the lights 19, 20 and 21. In this fashion, all four lights are turned on and 100% illumination is obtained.

One advantage of this design, from an economic point of view, is that only four diodes, two relays, two capacitors and a single switch are employed. Most importantly, from a cost point of view, this range of control requires only two simple normally open relays.

From an installation point of view having a single wire 46 extend from the switch 42 to the relays which are installed at the light fixture provides for a simple and inexpensive installation. If multiple light fixtures are to be controlled from the same switch 42, a line can be run from the connection point of the line 46 at a first fixture to the relays and diodes at the second fixture without requiring a separate line back to the switch.

The use of the AC main power source signal for the energization of the relays plus the self-contained nature of the components of the control circuit means that there is immunity from control signal degradation or error by virtue of ambient fields and electrical noise.

In one control circuit that has been built and tested 500 milliwatt relays were used; the capacitors were 0.56 microfarads and the diodes were IN4004 diodes.

If it is desired to control a large number of fluorescent fixtures in smaller stages than 25%, one could, for example, divide the bank of fixtures into two main subsets and within each subset, provide four groups; each group controlled in the fashion described herein.

The embodiment has been described in connection with a typical fixture having four ballasts and eight fluorescent tubes. That is a common design. The arrangement shown in the FIGURE can be extended to control any number of the four ballasts, eight tube fixtures by simply having the single line 46 from the switch 42 lead to a further set of relays and diodes such as the relays 32, 38 and diodes D1 and D3. In effect, the second fixture would be controlled in parallel with the first fixture and can be controlled in one-quarter illumination steps.

This invention can readily be adapted to other fixtures. For example, a sixteen tube, eight ballast fixture would be controlled by having two of the ballasts connected to the normally open contact 30, two of the ballasts to the normally open contact 34 and another two to the normally open contact 36.

A more variable step control might be provided in, for example, a fixture having five ballasts controlling ten tubes. In such a case, the relay contact 36 would be connected to the fourth and fifth ballast in parallel and the various positions of the switch would result in illumination in steps of 20%, 40%, 80% and 100%.

These known variations would be obvious to one skilled in the art.

While the foregoing description and drawing represent the presently preferred embodiment of the invention, it should be understood that those skilled in the art will be able to make changes and modifications to the embodiment without departing from the teachings of the invention and the scope of the claims.

For example, a single normally open contact could be used in lieu of the two contacts 34 and 36 to control the two lights 20 and 21. It is economic to design these contacts for a certain maximum current flow. Thus it is more convenient to have the two separate contacts 34 and 36 as shown.

The rotary switch 42 can be replaced by a sliding switch, or any kind of switch arrangements permitting the user to select any one of a set of terminals for the purposes discussed above.

What is claimed is:

1. A control system selectively illuminating fluorescent light units in a fluorescent fixture having a plurality of fluorescent light units energized from a main source of power comprising:

a first control circuit composed of a first diode and a first relay having at least a first normally open contact, a second control circuit having a second diode and a second relay having at least second and third normally open contacts, a control switch having at least a first position connecting said first control circuit to said power source and a second position connecting said second control circuit to said power source, said first position energizing said first circuit to close said first contact causing at least a first fluorescent light unit to be energized, said second position energizing said second circuit to close said second and third contacts causing at least second and third light units to be energized.

2. The control system of claim 1 wherein:

said control switch has a third position energizing both said first and second control circuits to close said first, second and third contacts causing at least first, second and third light units to be energized.

3. The control system of claim 1 wherein:

said control switch has a third diode connected to said first position and a fourth diode connected to said second position, said first and third diodes being in series and having the same polarity, said second and fourth diodes being in series and having the same polarity, the polarity of said third and fourth diodes being opposed to one another.

4. The control system of claim 2 wherein:

said control switch has a third diode connected to said first position and a fourth diode connected to said second position, said first and third diodes being in series and having the same polarity, said second and fourth diodes being in series and having the same polarity, the polarity of said third and fourth diodes being opposed to one another.

5. The control system of claim 1 wherein:

said first and second control circuits are mounted adjacent to the fluorescent fixture being controlled and said control switch is connected to said control circuits by a single wire extending from the location of said control switch to the location of said control circuits.

6. The control system of claim 2 wherein:

said first and second control circuits are mounted adjacent to the fluorescent fixture being controlled and said control switch is connected to said control circuits by a single wire extending from the location of said control switch to the location of said control circuits.

7. The control system of claim 3 wherein:

said first and second control circuits are mounted adjacent to the fluorescent fixture being controlled and said control switch is connected to said control circuits by a single wire extending from the location of said control switch to the location of said control circuits.

8. The control system of claim 4 wherein:

said first and second control circuits are mounted adjacent to the fluorescent fixture being controlled and said control switch is connected to said control circuits by a single wire extending from the location of said control switch to the location of said control circuits.

9. The control system of claim 2 wherein: said control switch has a fourth position in which said first, second and third light units are not energized.

10. The control system of claim 4 wherein: said control switch has a fourth position in which said first, second and third light units are not energized.

11. The control system of claim 6 wherein: said control switch has a fourth position in which said first, second and third light units are not energized.

12. The control system of claim 8 wherein: said control switch has a fourth position in which said first, second and third light units are not energized.

13. A control system for a fluorescent fixture having a power input adapted to be connected to a source of electrical power, comprising a set of at least four fluorescent light units, each having a ballast, a set of at least two relay control circuits, each of said circuits having at least one normally open contact, a first one of said light units being connected to a the power input, a first one of said relay circuits being coupled to a second one of said light units, said first one of said relay circuits having a first normally open contact, energization of said first relay closing said first normally open contact to connect said second light unit to the power input, a second one of said relay circuits being coupled to third and fourth ones of said light units, said second one of said relay circuits having second and third normally open contacts, energization of said second relay closing said second and third contacts to connect said third and fourth fluorescent light units to the power input, a control switch circuit having a switch arm connectable to any one of first, second, third and fourth contacts, connection of said arm to said first contact blocking energy from said first and second relay circuits, connection of said arm to said second contact energizing said first relay circuit, connection of said arm to said third contact energizing said second relay circuit, connection of said arm to said fourth contact energizing both said first and second relay circuits, whereby selective switch connection provides selection of 25%, 50%, 75% or 100% illumination from the fluorescent fixture.

14. The fluorescent fixture of claim 13 further comprising:

a first diode in said first relay circuit, a second diode in second relay circuit, a third diode connected to said second position of said control switch circuit and a fourth diode connected to said third position of said control switch circuit, said first and third diodes being in series and having the same polarity, said second and fourth diodes being in series and having the same polarity, the polarity of said third and fourth diodes being opposed to one another.

15. The control system of claim 13 wherein:

said first and second control circuits are mounted adjacent to the fluorescent fixture being controlled and said control switch is connected to said control circuits by a single wire extending from the location of said control switch to the location of said control circuits.

16. The control system of claim 14 wherein:

said first and second control circuits are mounted adjacent to the fluorescent fixture being controlled and said control switch is connected to said control circuits by a single wire extending from the location of said control switch to the location of said control circuits.

* * * * *